US006240690B1

(12) United States Patent
James et al.

(10) Patent No.: US 6,240,690 B1
(45) Date of Patent: Jun. 5, 2001

(54) VENTED METAL ROOF

(75) Inventors: Clifford H. James; Michael James, both of Navasota, TX (US)

(73) Assignee: Roof & Metal Systems, Inc., Navasota, TX (US)

( * ) Notice: Subject to any disclaimer, the term of this patent is extended or adjusted under 35 U.S.C. 154(b) by 0 days.

(21) Appl. No.: 09/496,396

(22) Filed: Feb. 2, 2000

(51) Int. Cl.[7] ..... E04B 1/70

(52) U.S. Cl. ..... 52/302.3; 52/302.1; 52/199; 52/95; 52/96; 454/365; 454/366; 454/260; 454/250

(58) Field of Search ..... 52/302.1, 302.3, 52/302.6, 198, 199, 95, 96; 454/250, 260, 265, 365, 366

(56) References Cited

U.S. PATENT DOCUMENTS

| | | | | |
|---|---|---|---|---|
| 5,022,203 | * | 6/1991 | Boyd | 52/199 |
| 5,427,571 | * | 6/1995 | Sells | 454/365 |
| 5,561,953 | | 10/1996 | Rotter . | |
| 5,605,022 | * | 2/1997 | Fulton | 52/199 |
| 5,826,383 | | 10/1998 | Garrison . | |
| 5,924,925 | | 7/1999 | Nystrom . | |

* cited by examiner

*Primary Examiner*—Carl D. Friedman
*Assistant Examiner*—Yvonne M. Horton
(74) *Attorney, Agent, or Firm*—Wendy K. Buskop; Buskop Law Group, P.C.

(57) ABSTRACT

A novel metal roof is described for passive ventilation of building structures. A ridge vent is described that provides enhanced ventilation of the roof, and provides for safer and economical installation of the metal roof ventilation system.

26 Claims, 3 Drawing Sheets

60
75
35
30
10
15
70
25
20

VENTED METAL ROOF

BACKGROUND OF THE INVENTION

1. Field of the Invention

The present invention relates to attic and roof ventilation systems and more particularly to providing ventilation to sloped roof structures having metal roofs.

2. Description of the Background

The practice of ventilating sloped roofs structures by creating a vent opening along the roof ridge is well known in the construction industry. A vent slot is created during construction by leaving a gap between the roof deck and the roof beam running along the ridge extending essentially the length of the roof. The air is vented from the structure by convection airflow and by suction from wind blowing across the roof. The vent slot must be covered to keep water, dirt and pests out of the structure. The required covering in turn diminishes the air flow from under the roof. Typically, in metal roof installations, a ridge panel or cap is connected to the top row of roof panels atop the ridge slot with a closure strip or mastic disposed between the ridge panel and the roof panels. However, covering the ridge slot prevents the desired ventilation from under the roof. Another well known method in the construction industry involves installing ventilators atop the ridge slot. However, that ventilator installation requires additional labor which is very effective expensive.

Powered fan ventilation is well-known for buildings. However, the power required to operate the fan in such devices requires an additional power outlet installation for the roof. Also, ventilating the building in this manner may be cost prohibitive because of the energy cost, and there is potential fire hazard associated with unattended electrical appliance operation. Passive, convection type vents provide an economical and safe alternative to powered fans for ventilating buildings. In buildings having peaked roofs, the natural flow of air within the building rises to the uppermost area, which is typically adjacent the peak of the roof. Several attempts have been made to overcome the problems of passive ventilating the metal roofs. U.S. Pat. No. 5,561,953 discloses a contoured ventilation system for metal roofs that requires a sheet overlaying the decking wherein the sheet has a plurality of projections projecting away from the decking, and a strip having a surface including a plurality of recesses shaped to match the projections of the sheet. The requirement of having such a sheet adds to the expense and further degrades the ventilation efficiency. U.S. Pat. No. 5,826,383 describes a roof closure vent system in which the ridge closure vent requires a closure member having lateral perforations for air to pass through, and a mesh mat adjacent to the closure member. Ventilation through a perforated members reduces ventilation efficiency by reducing the available vent volume, and further the perforated member is subject to degradation over time. A roof ventilating system for frame construction building is described in U.S. Pat. No. 5,924,925 that discloses a vent cover assembly in which flashing strips are installed to the vent cover. The vent cover assembly is mounted over the vent opening. Clearly, additional weight of the vent cover and flashing strips reduces passive ventilation efficiency of the system.

Therefore, it is an objective of this invention to provide an effective passive ventilation system for metal roofs without any moving parts that adversely impact ventilation efficiency. Another objective of the invention is to eliminate use of any porous sheet or use of the like material that may degrade over time and that adversely impacts ventilation efficiency. It is yet another objective of the invention to provide a safe and economic installation of the metal roof on building structures.

SUMMARY

A metal roof for a building structure is disclosed that has at least two parallel sloped roof rafters joined to one side of a roof beam. At least one deck is connected to the roof rafters creating a vent slot between the deck and the roof rafters where the deck is substantially parallel to the roof beam. The metal roof requires at least one ridge vent, having a base side, a first side, and a second side. The angle between the first side and the base side of the ridge vent is about 100° or less, and the angle between the second side and the base side is about 100° or less. The first side and the second side of the ridge vent are oriented in the same direction, and the ridge vent has at least one vent opening located on the base side. The first side of the ridge vent is attached to the deck substantially parallel to and in proximity of the vent slot. A metal roof ridge is removably secured to the second side of the ridge vent. A metal roof panel is attached to the deck, where a panel side of the metal roof panel is in close proximity to the vent slot. The panel side of the metal roof panel is bent at an angle from the deck to form a panel bend slightly smaller than the opening of the ridge vent. The panel bend is inserted in to the opening of the ridge vent. The metal roof panel has ribs substantially perpendicular to the vent slot, and the height of the ribs is sufficient for securely inserting the metal roof panel into the opening of the ridge vent. The metal roof panel is secured on the deck by suitable means known in the construction industry.

DETAILED DESCRIPTION OF PREFERRED EMBODIMENTS

Figure 1:
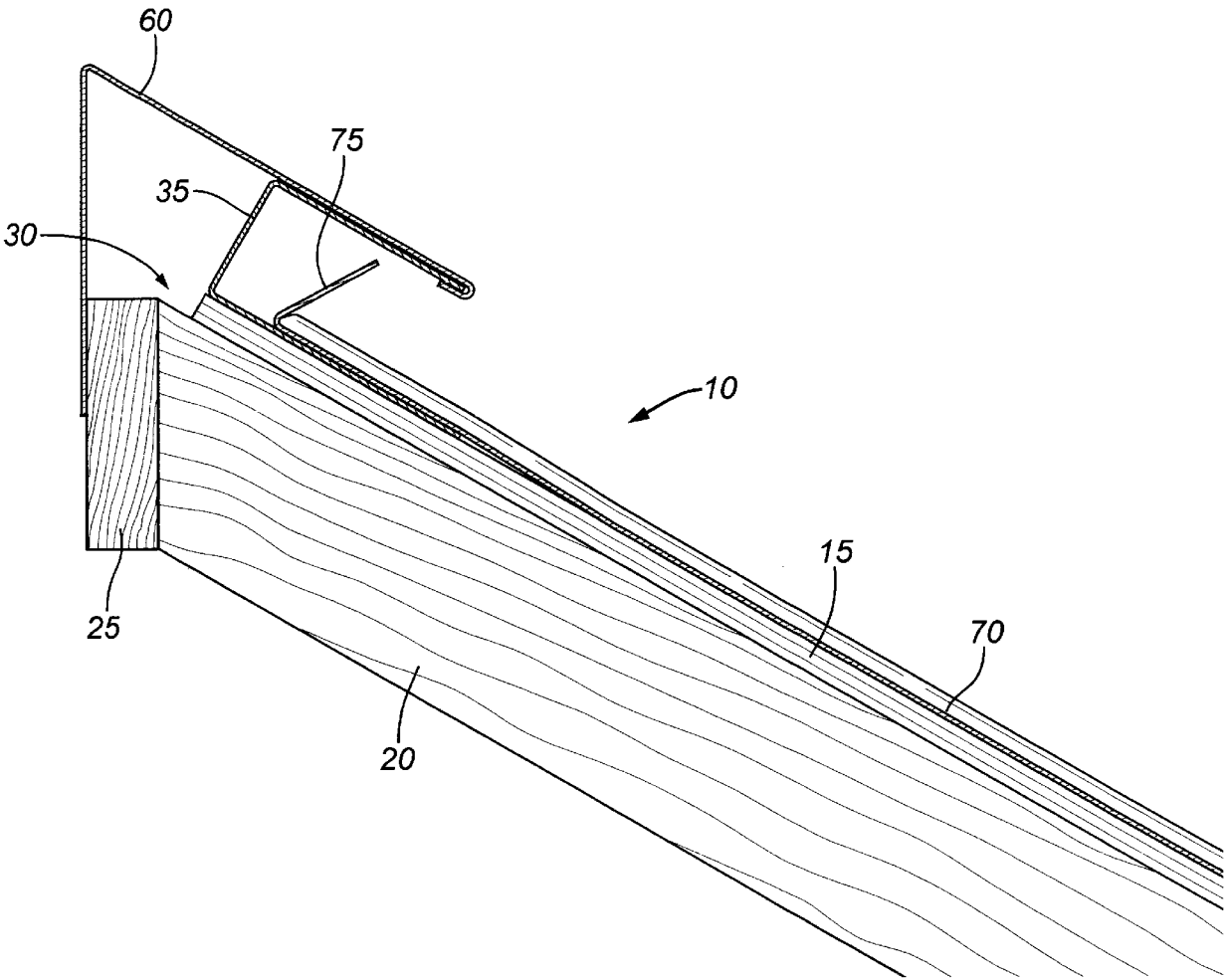
FIG. 1 is a partially exploded cross sectional view of a metal roof requiring roofing only on one side.
Figure 2:
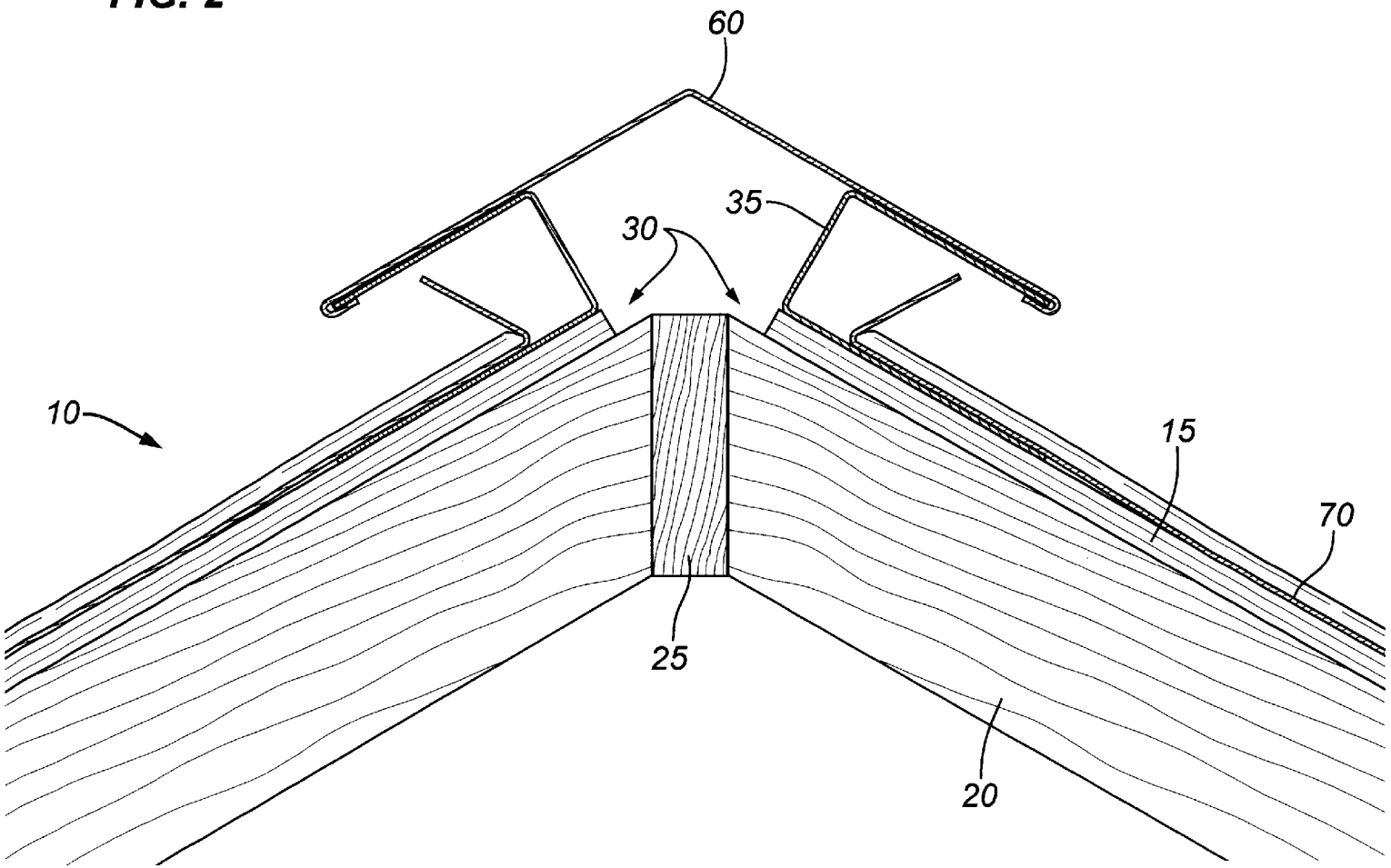
FIG. 2 is a partially exploded cross sectional view of a sloped metal roof requiring roofing on two sides.

FIG. 1 is a partially exploded cross sectional view of a sloped metal roof requiring roofing only on one side, and FIG. 2 is a partially exploded cross sectional view of a sloped metal roof requiring roofing on two sides. Referring to FIG. 1, there is a metal roof 10 having at least two sloped parallel roof rafters 20 joined to one side of a roof beam 25 to support a deck 15. FIG. 2 shows a roof having two sloped sides requiring two decks 15 each supported on at least two roof rafters 20. The roof rafters 20 and the deck 15 are typically made of suitable wood but in large structures, the roof rafters 20 and the deck 15 may be made of metals, and other suitable combination of materials conventionally used therefor. In wooden structures the roof rafters 20 are typically connected to the roof beam 25 by wood nails but other means known in the building industry can be conveniently used. The deck 15 is supported on the roof rafters 20 and is attached thereon by wood nails for wooden structures. However, other suitable means like screws, bolts, adhesives, and combinations thereof may be used to attach the deck 15 on the roof rafters 20. The deck 15 is attached to the roof rafters 20 such that a vent slot 30 is formed along the length of the roof beam 25. In the case where roofing is required on two sides (FIG. 2), the vent slot 30 is formed on both sides of the roof beam 25 along the length of the roof beam 25.

Figure 3:
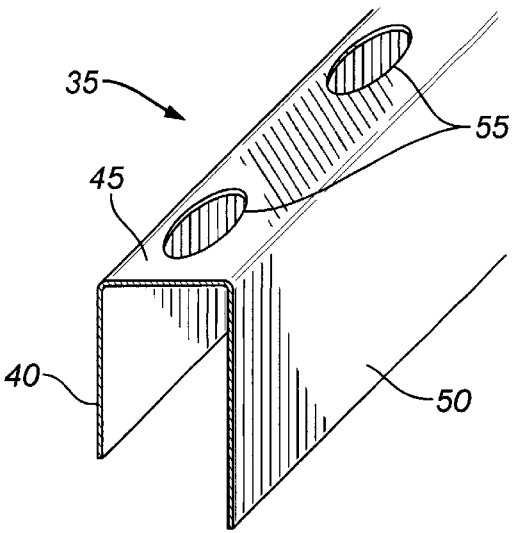
FIG. 3 is an isometric view of a ridge vent showing vent openings.

FIG. 3 shows an isometric view of a ridge vent 35 showing vent openings 55. The ridge vent 35 has a first side 40, a second side 50, and a base side 45. An important objective in designing the structure is that it provide maximum vent opening area for maximum ventilation and also provide maximum protection against rain water and roof washing water entry, and flying insects entry in to the roof interior. At a minimum one vent opening 55 is necessary to achieve advantage of additional ventilation through the roof. In a preferred embodiment, numerous vent openings 55 are provided to achieve enhanced ventilation through the roof. The vent openings 55 are oval shaped and are shifted upwards to the highest position on the second side 50 to within structurally permissible limits so that structural strength of the ridge vent 35 is not unduly diminished. The oval shape and positioning of the vent openings 55 provides large vent opening area for maximum ventilation, and provides maximum protection against rain water entry in to the roof interior. The vent openings 55 in a preferred embodiment are covered with a bird screen to obstruct entry of flying insects in to the roof. The bend angle between adjacent sides of the ridge vent 35 is kept between 80° and 100° to accommodate situation specific scenarios of the specific building structure and practical limitations of manufacturing the ridge vent 35. Generally, one ridge vent 35 for a straight segment of the roof beam 25 is adequate for providing the metal roof of this invention. However, for long segments of the roof beam 25 several units of the ridge vent 35 may be required. Similarly, sections of the ridge vent 35 may be used sequentially where the roof profile so dictates. The relative size of the first side 40 and the second side 50 of the ridge vent 35 can be varied to accommodate other construction requirements and/or practical consideration of providing adequate strength to the ridge vent 35. The ridge vent 35 can be attached to the deck 15 by wood nails, screws, nut-bolts, adhesives and combinations thereof.

Figure 4:
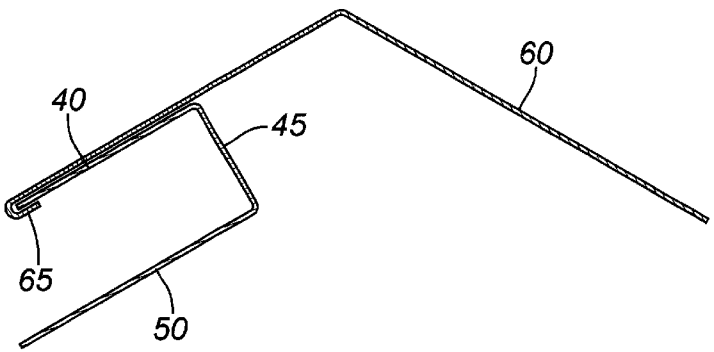
FIG. 4 is a cross sectional view of a metal roof ridge and a ridge vent showing a locking bend.

FIG. 4 shows a metal roof ridge 60 for the metal roof 10 requiring roofing on two sides of the structure. FIG. 1 shows the metal roof ridge 60 for the metal roof 10 requiring roofing on only one side. The metal roof ridge 60 in a preferred embodiment is V-shaped. However, the metal roof ridge 60 may be made as U-shaped, C-shaped, or any suitable variations thereof may be adapted. The shape of the metal roof ridge 60 is not critical because the function of the metal roof ridge 60 is to provide additional volume for the hot air escape route. FIG. 4 shows the metal roof ridge 60 attached to the first side 40 of the ridge vent 35 by a locking bend 65. The locking bend 65 is formed when the edge of the side of the metal roof ridge 60 that is in proximity to the edge of the first side 40 of the ridge vent 35 is bent around the edge of the first side 40. Alternatively or in addition, rivets, nut bolts, adhesive, and combinations thereof may be used to attach the ridge vent 35 to the metal roof ridge 60.

Figure 5:
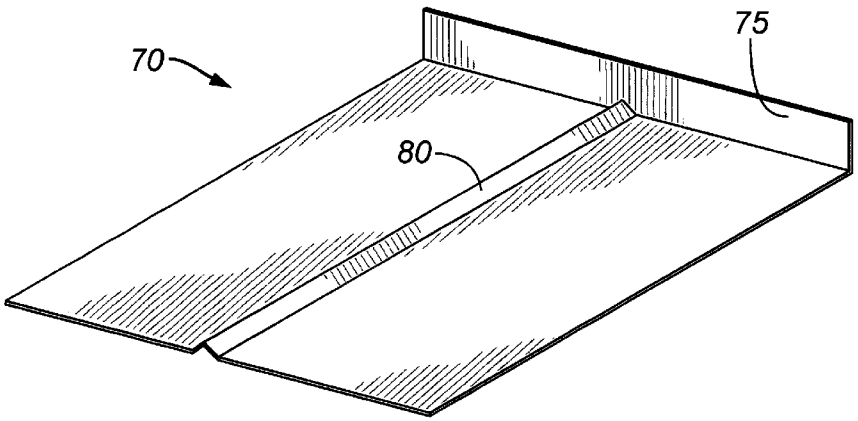
FIG. 5 shows a metal roof panel having a metal bend and a sample rib.

FIG. 1 shows a metal roof panel 70 attached on the deck 15. The metal roof panel 70 is sized to substantially cover the deck 15. The panel side of the metal roof panel 70 that is in close proximity to the vent slot 30 is bent at an angle, as shown in FIGS. 1 and 2, and 5 to form a panel bend 75 that is slightly smaller in height than the opening of the ridge vent 35. The panel bend 75 is inserted in to the opening of the ridge vent 35. The panel bend 75 forms an angle approximately between 45° and 100°. Such a range of the angle of the panel bend 75 provides flexibility to suit the varying construction requirements of different structures where the objective is to obstruct external water entry in to the roof and at the same time maximize air volume space to facilitate ventilation through the roof. In a preferred embodiment the panel bend 75 forms an angle of approximately 45°. The metal roof panel 70 has ribs 80 substantially perpendicular to the vent slot 30 (FIG. 5). The height of the ribs 80 is sufficient for securely inserting the metal roof panel 70 in to the opening of the ridge vent 35. The ribs 80 provide structural support to the metal roof ridge 60 and also to the ridge vent 35. In addition, the ribs 80 provide additional air flow path for ventilation of the roof.

The metal roof panel 70 is secured on the deck 15 by conventional means used in the construction industry. In a preferred embodiment bolts and nuts are used to attach the metal roof panel 70 to the deck 15. Other means of securing the metal roof panel 70 to the deck 15 are screws, adhesives, nails, and combinations thereof.

In a preferred embodiment the metal roof panel 70 is made of galvanized steel sheet. The galvanized steel sheet can be painted with weather protective paints and/or decorative paints. Other suitable material for the metal roof panel 70 are galvalume, aluminum metal sheet, and other metal sheets that are weather resistant, fire resistant, hail resistant and are structurally suitable for the metal roof.

To make the ridge vent 35 of this invention a metal sheet is bent to form a base side 45, a first side 40, and a second side 50 (FIG. 3). The angle between the first side 40 and the base side 40 is about 100° or less, the angle between the second side 50 and the base side 45 is about 100° or less, and the first side 40, and the second side 50 are oriented in the same direction. As mentioned above, the choice of angle between the sides of the ridge vent 35 provides construction flexibility where the primary objective is to prevent external water entry into the roof. At least one vent openings 55 is provided on the base side 45. However, as many as feasible number of the vent openings 55 is provided on the base side 45 to gain maximum advantage of the invention in providing ventilation of the roof. The vent openings 55 are covered with bird screen to prevent entry of flying insects in to the roof.

Referring to FIGS. 1 and 2, a method of installing the metal roof vent system of this invention comprises of following steps: (1) the ridge vent 35 described earlier is installed on the deck 15 in the proximity of the vent slot 30 substantially along the length of the roof beam 25 with the base side 45 of the ridge vent 35 oriented towards the vent slot 30, and the second side 50 of the ridge vent 35 is attached to the deck 15 using nails, screws, nut bolts, adhesives, and any other combinations thereof. Two ridge vents 35 are required for a roof having two sloped decks 15. In case of long roofs multiple ridge vents 35 may be installed sequentially to adapt the ridge vent 35 along the desired length of the ridge vent 35. The positioning of the ridge vent 35 is such that the metal roof ridge 60 can be attached to the ridge vent 35. (2) The metal roof ridge 60 is attached to the first side 40 of the ridge vent 35 by means of rivets, screws, adhesives, locking bend, and combinations thereof. In a preferred embodiment the metal roof ridge 60 is attached to the first side 40 of the ridge vent 35 by means of a combination of a locking bend and rivets. (3) The metal roof panel 70 covering the deck 15 is attached to the deck 15 by means of nails, screws, nut bolts, adhesives, and combinations thereof. The panel bend 75 of the metal roof panel 70 is inserted into the opening of the ridge vent 35 keeping a sufficient gap between the base side 45 of the ridge vent 35 and the panel bend 75 to provide adequate volume space for ventilation of the roof. Also, part of the ribs 80 is inserted into the opening of the ridge vent 35 to provide structural support to the first side 40 of the ridge vent 35 and also to the metal roof ridge 60. The ribs 80 also provide additional airflow path for ventilation from the roof.

The method of installation of the metal roof 10 has distinct advantages over the commonly known and used methods of metal roof installation. In the method described herein, installation of the metal roof panel 70 is the last step in the metal roof 10 installation process, whereas in the conventional methods of installation of the metal roof 10 the metal roof panel 70 is installed first or is an intermediate step. The metal roof 10 has a slippery surface and presents an unsafe condition for the work personnel. Consequently, additional safety equipment and additional labor are required in the conventional methods of installing metal roofs on building structures. In contrast, in the invention described herein the metal roof panel 70 is safely attached to the metal roof ridge 60 whereas the ridge vent 35 and the metal roof ridge 60 have already been installed without the need for humans to walk on unsafe metal surface, and without requiring additional safety equipment. In a preferred embodiment the metal roof panel 70 and the deck 15 have pre-drilled aligned holes for nut bolt attachment making attachment of the metal roof panel 70 and the deck 15 a straightforward and quick, safe, and economical process.

The description provided herein is an illustration of the application of the invention. The above description is not intended to be limited to above illustration only because numerous variations of the invention, within the limitations of the claims of the invention are possible.

What is claimed is:

1. A metal roof for a building structure comprising:

a. at least two parallel sloped roof rafters adapted to be joined to one side of a roof beam;

b. at least one deck connected to said roof rafters creating a vent slot between said at least one deck and said roof rafters and wherein said at least one deck is adapted to be substantially parallel to said roof beam;

c. at least one ridge vent, having a base side, a first side, and a second side, wherein the angle between said first side and said base side is about 100° or less, the angle between said second side and said base side is about 100° or less, and further wherein said first side and said second side are oriented in the same direction, and further said at least one ridge vent having at least one vent opening located on said base side, and wherein said first side of said at least one ridge vent is attached to said at least one deck substantially parallel to and in proximity of said vent slot;

d. a metal roof ridge removably secured to said second side of said at least one ridge vent;

e. at least one metal roof panel covering and attached to said at least one deck, said at least one metal roof panel having a panel side in close proximity to said vent slot, wherein said panel side is bent at an angle from said at least one deck to form a panel bend slightly smaller than the opening of said at least one ridge vent, and further said panel bend is inserted in to said opening of said at least one ridge vent, and further said at least one metal roof panel has ribs substantially perpendicular to said vent slot, wherein the height of said ribs is sufficient for securely inserting said at least one metal roof panel into said opening of said at least one ridge vent; and f. means for securing said metal roof panel on said at least one deck.

2. The structure of claim 1 wherein said at least one vent opening is oval.

3. The structure of claim 1 wherein said at least one vent opening is placed at the highest position on said base side.

4. The structure of claim 1 comprising a plurality of said at least one ridge vent placed sequentially to adapt to different segments of said metal roof.

5. The structure of claim 1 wherein said metal roof ridge is V-shaped.

6. The structure of claim 1 wherein said metal roof ridge is secured to said at least one ridge vent by means selected from the group consisting of rivets, nut bolts, adhesive, locking bend, and combinations thereof.

7. The structure of claim 1 wherein the length of said first side and the length of said second side of said at least one ridge vent are of different lengths.

8. The structure of claim 1 wherein shape of said ribs is selected from the group consisting of V-shaped, U-shaped, C-shaped, and combinations thereof.

9. The structure of claim 1 wherein angle of said panel bend is between approximately 45° and 100°.

10. The structure of claim 1 wherein said metal roof panel is made of fire resistant and hail resistant material selected from the group consisting of galvanized steel sheet, galvalume sheet, and aluminum sheet.

11. A method of installing a metal roof vent system on a building structure having a sloped roof formed by at least two parallel sloped roof rafters adapted to be joined to one side of a roof beam, and at least one deck connected to said roof rafters creating a vent slot between said at least one deck and said roof rafters and wherein said at least one deck is adapted to be substantially parallel to said roof beam comprising steps of:

a. installing at least one ridge vent, having a base side, a first side, and a second side, wherein the angle between said first side and said base side is about 100° or less, the angle between said second side and said base side is about 100° or less, and further wherein said first side and said second side are oriented in the same direction, and further said at least one ridge vent having at least one vent opening located on said base side, and wherein said first side of said at least one ridge vent is attached to said at least one deck substantially parallel to and in proximity of said vent slot;

b. installing a metal roof ridge removably secured to said second side of said at least one ridge vent;

c. attaching at least one metal roof panel covering and attached to said at least one deck, said at least one metal roof panel having a panel side in close proximity to said vent slot, wherein said panel side is bent at an angle from said at least one deck to form a panel bend slightly smaller than the opening of said at least one ridge vent, and further said panel bend is inserted in to said opening of said at least one ridge vent, and further said at least one metal roof panel has ribs substantially perpendicular to said vent slot, wherein the height of said ribs is sufficient for securely inserting said at least one metal roof panel into said opening of said at least one ridge vent; and d. securing said metal roof panel on said at least one deck wherein said panel bend is inserted in said at least one ridge vent.

12. The method of claim 11 further comprising the step of placing said at least one vent opening at the highest position on said base side.

13. The method of claim 11 further comprising the step of placing said at least one ridge vent sequentially next to another at least one ridge vent to adapt to different segments of said metal roof.

14. A ridge vent for providing venting in metal roofs of building structures comprising;

a. a metal sheet bent to form a base side, a first side, and a second side, wherein the angle between said first side and said base side is about 100° or less, the angle between said second side and said base side is about 100° or less, and further wherein said first side and said second side are oriented in the same direction;

b. at least one vent opening disposed on said base side; and c. said at least one vent opening has a bird screen installed thereon.

15. The metal vent of claim 14 wherein said at least one vent opening is oval shaped.

16. The metal vent of claim 14 wherein said at least one vent opening is placed at the highest position on said base side.

17. A building structure having a metal roof comprising:

a. a building structure;

b. at least two parallel sloped roof rafters adapted to be joined to one side of a roof beam;

c. at least one deck connected to said roof rafters creating a vent slot between said at least one deck and said roof rafters and wherein said at least one deck is adapted to be substantially parallel to said roof beam;

d. at least one ridge vent, having a base side, a first side, and a second side, wherein the angle between said first side and said base side is about 100° or less, the angle between said second side and said base side is about 100° or less, and further wherein said first side and said second side are oriented in the same direction, and further said at least one ridge vent having at least one vent opening located on said base side, and wherein said first side of said at least one ridge vent is attached to said at least one deck substantially parallel to and in proximity of said vent slot;

e. a metal roof ridge removably secured to said second side of said at least one ridge vent;

f. at least one metal roof panel covering and attached to said at least one deck, said at least one metal roof panel having a panel side in close proximity to said vent slot, wherein said panel side is bent at an angle from said at least one deck to form a panel bend slightly smaller than the opening of said at least one ridge vent, and further said panel bend is inserted in to said opening of said at least one ridge vent, and further said at least one metal roof panel has ribs substantially perpendicular to said vent slot, wherein the height of said ribs is sufficient for securely inserting said at least one metal roof panel into said opening of said at least one ridge vent; and g. means for securing said metal roof panel on said at least one deck.

18. The building structure of claim 17 wherein said at least one vent opening is oval.

19. The building structure of claim 17 wherein said at least one vent opening is placed at the highest position on said base side.

20. The building structure of claim 17 wherein there is a plurality of at least one ridge vent placed sequentially to adapt to different segments of said metal roof.

21. The building structure of claim 17 wherein said metal roof ridge is V-shaped.

22. The building structure of claim 17 wherein said metal roof ridge is secured to said at least one ridge vent by means selected from the group consisting of: rivets, nut bolts, adhesive, locking bend, and combinations thereof.

23. The building structure of claim 17 wherein length of said first side and said second side of said at least one ridge vent is unequal to adjust for attachment of said metal roof panel and said roof ridge vent.

24. The building structure of claim 17 wherein shape of said ribs is selected from the group consisting of V-shaped, U-shaped, C-shaped, and combinations thereof.

25. The building structure of claim 17 wherein angle of said panel bend is between approximately 45° and 100°.

26. The building structure of claim 17 wherein said metal roof panel is made of fire resistant and hail resistant material selected from the group consisting of: galvanized steel sheet, galvalume sheet, and aluminum sheet.

* * * * *